US006371603B1

(12) United States Patent
Seto

(10) Patent No.: US 6,371,603 B1
(45) Date of Patent: Apr. 16, 2002

(54) INK-JET RECORDING HEAD WITH STACKED INDIVIDUAL HEAD UNITS

(75) Inventor: Shinji Seto, Tokyo (JP)

(73) Assignee: NEC Corporation (JP)

( * ) Notice: Subject to any disclaimer, the term of this patent is extended or adjusted under 35 U.S.C. 154(b) by 0 days.

(21) Appl. No.: 09/715,286

(22) Filed: Nov. 17, 2000

(30) Foreign Application Priority Data

Nov. 18, 1999 (JP) ..... 11-328226

(51) Int. Cl.[7] ..... B41J 2/045
(52) U.S. Cl. ..... 347/71
(58) Field of Search ..... 347/68, 54, 20, 347/71, 70

(56) References Cited

U.S. PATENT DOCUMENTS 4,455,560 A * 6/1984 Louzil ..... 347/71
5,872,580 A * 2/1999 Ochi et al. ..... 347/40

FOREIGN PATENT DOCUMENTS

JP 3-15555 1/1991 ..... B41J/2/045

* cited by examiner

*Primary Examiner*—Judy Nguyen
(74) *Attorney, Agent, or Firm*—Dickstein Shapiro Morin & Oshinsky LLP

(57) ABSTRACT

An ink-jet recording head including a plurality of pressure chambers which are stacked with one another. In the present invention, the pressure chambers preferably arranged in a vertical direction are at least partially overlapped with one another viewed from the ink ejection side. Thereby, when the number of the ink nozzles is increased for responding to the demand of the higher density, the area occupied by the pressure chambers is never increased or not increased proportionally. Accordingly, the smaller dimensions and the higher density can be realized for the recording head.

7 Claims, 8 Drawing Sheets

INK-JET RECORDING HEAD WITH STACKED INDIVIDUAL HEAD UNITS

BACKGROUND OF THE INVENTION

1. Field of the Invention

The present invention relates to an ink-jet recording head, and especially to the ink-jet recording head which can realize the higher density arrangement of ink nozzles.

2. Description of the Related Art

A non-impact recording method attracts public attention because this method is excellent in negligibly small noise at the time of recording. The ink-jet recording method included in the non-impact recording method has the advantages that a high speed recording is possible directly on a recording medium by using a simple mechanism. An ordinary paper can be used as the recording medium.

The ink-jet recording method is conducted by directly adhering ink droplets ejected from a recording head directly onto recording paper for recording letters and fingers. The ink-jet recording method has the advantages of conducting the recording without special fixation treatment to the ordinary paper in addition to conducting the high speed recording. A variety of ink-jet printers are proposed and commercialized.

A main stream of the ink-jet printers in recent days includes a piezoelectric element which converts an electric signal into mechanical energy as a pressure applying means for ejecting ink hereinafter referred to as "piezoelectric type". Still another embodiment of such printers includes a heater converting an electric signal into thermal energy as the pressure-applying means (hereinafter referred to as "thermal type"). The basic structures and operations of both of the printers of the piezoelectric type and the thermal type are not different except for the pressure-generation system, and only the piezoelectric type will be described.

A conventional ink-jet recording head of the piezoelectric type is described in JP-A-3(1991)-15555, and the configuration of the ink-jet recording head described therein is shown in FIG. 1. The ink-jet recording head includes a nozzle plate 11 having ink nozzles 10, and an ink pool 15 is defined by the nozzle plate 11, an ink pool plate 12 and an ink supply plate 13. A plurality of pressure chambers 18 are defined by a pressure chamber plate 16 and a vibration plate 17. Each of the pressure chambers 18 is communicated to the ink pool 15 through an ink supply port 19, and the vibration plate 17 includes stripe piezoelectric elements 20 each corresponding to each of the pressure chambers 18. Although each of the components is shown as a single element in FIG. 1, one or more plates may be integrally formed. Signal lines for transmitting electric signals to the piezoelectric elements 20 and ink paths for filling ink in the ink pool 15 are omitted in the drawings.

The operational principle in accordance with the Junio-moruv effect in the ink-jet recording head will be described referring to FIGS. 2A and 2B. Each of the piezoelectric elements 20 includes a first electrode 22*a* on a side in contact with the vibration plate 17 and a second electrode 22*b* on the reverse side, and the piezoelectric elements 20 have a polarization directed in the plate thickness direction (in the direction "P" in FIG. 2A). The vibration plate 17 to which each of the first electrode 22*a* of the piezoelectric elements 20 is communicated and a switching circuit 23 to which each of the second electrodes 22*b* is communicated are communicated to one and the other terminals of a driving source 24, respectively.

When the switching circuit 23 is turned on upon the input of a print order, a voltage is applied to the corresponding piezoelectric elements 20 from the driving source 24, and the piezoelectric elements 20 becomes contracted in the direction (in the direction "e" in FIG. 2B) perpendicular to the plate thickness direction due to the piezoelectric transversal effect. At this stage, an amount of the distortion at the first electrode 22*a* side of the piezoelectric elements 20 is smaller because the first electrode 22*a* side is fixed to the vibration plate 17 and has an electric charge. Thereby, the amounts of the distortion of the both surfaces of the piezoelectric elements 20 are different, and the piezoelectric elements 20 flexibly deforms in the plate thickness direction (in the direction "f" in FIG. 2B) to reduce the volume of the corresponding pressure chamber 18 thereby increasing the inner pressure of the pressure chamber 18.

In FIG. 3A showing the sectional view at the time of the operation of the ink-jet recording head in accordance with the above operation principle, the ink is filled in the ink pool 15, the ink supply port 19, the pressure chambers 18 and the ink nozzles 10. When the switching circuit 23 (FIGS. 2A and 2B) is turned on in accordance with the printing order under the circumstance, the ink in the printing chamber 18 is pressurized by the piezoelectric elements 20 (arrow "g") as shown in FIG. 3B to be ejected through the ink nozzle 10 because the pressure is open to the ink nozzle 10 and the ink supply path 19 (arrows "k" and "m").

When the switching circuit 23 (FIGS. 2A and 2B) is turned off as shown in FIG. 3C, the internal of the pressure chamber 18 returns to the initial state as shown in FIG. 3A because the application of the pressure by the piezoelectric elements 20 is released (arrow "h"). At this stage, the pressure chamber 18 is refilled with the ink flowing from the ink pool 15 side by the ejection through the ink supply port 19 as shown by an arrow "n" to complete the series of operations. The series of the operations are repeated at the high speed to conduct the printing.

In the conventional ink-jet recording head, the reduction of the recording head area viewed from the ink ejection side is limited because a plurality of the pressure chambers 18 are flatly arranged and a minimum head width is desired which equals to the sum of the widths of the pressure chambers 18 and the intervals between the adjacent pressure chambers 18. Therefore, an area occupied by the pressure chambers increases with the increase of the number of the ink nozzles for responding to the high density, and the demand for the higher density of the ink nozzles and the miniaturization of the recording head are trade-off.

SUMMARY OF THE INVENTION

In view of the foregoing, an object of the present invention is to provide an ink-jet recording head which promotes a higher density of ink nozzles while realizing smaller dimensions for the ink-jet recording head.

The present invention provides an ink-jet recording head including: an ink pool; a plurality of pressure chambers each communicated to the ink pool; a plurality of ink nozzles each communicated to a corresponding one of the pressure chambers; and a plurality of piezoelectric elements each for ejecting ink droplets through a corresponding one of the ink nozzles by exerting a pressure to a corresponding one of the pressure chambers; the pressure chambers and the piezoelectric element being alternately stacked.

In accordance with the present invention, the pressure chambers are stacked with one another viewed from the ink ejection side because the pressure chambers having the piezoelectric element are arranged vertically or stepwise. Thereby, when the number of ink nozzles is increased for responding to the demand for a higher density, the area occupied by the pressure chambers can be reduced. A particularly advantageous structure of the recording head includes ink nozzles communicating with end zones of respective pressure chambers. Accordingly, the smaller dimensions and the higher density can be realized for the recording head.

The above and other objects, features and advantages of the present invention will be more apparent from the following description.

BRIEF DESCRIPTION OF DRAWINGS

FIG. 2A shows a state before operation and FIG. 2B shows a state during the operation.

FIG. 3A shows an initial state, FIG. 3B shows an ink-ejecting state and FIG. 3C shows a refilled state.

PREFERRED EMBODIMENTS OF THE INVENTION

Now, the present invention is more specifically described with reference to accompanying drawings.

Figure 1:
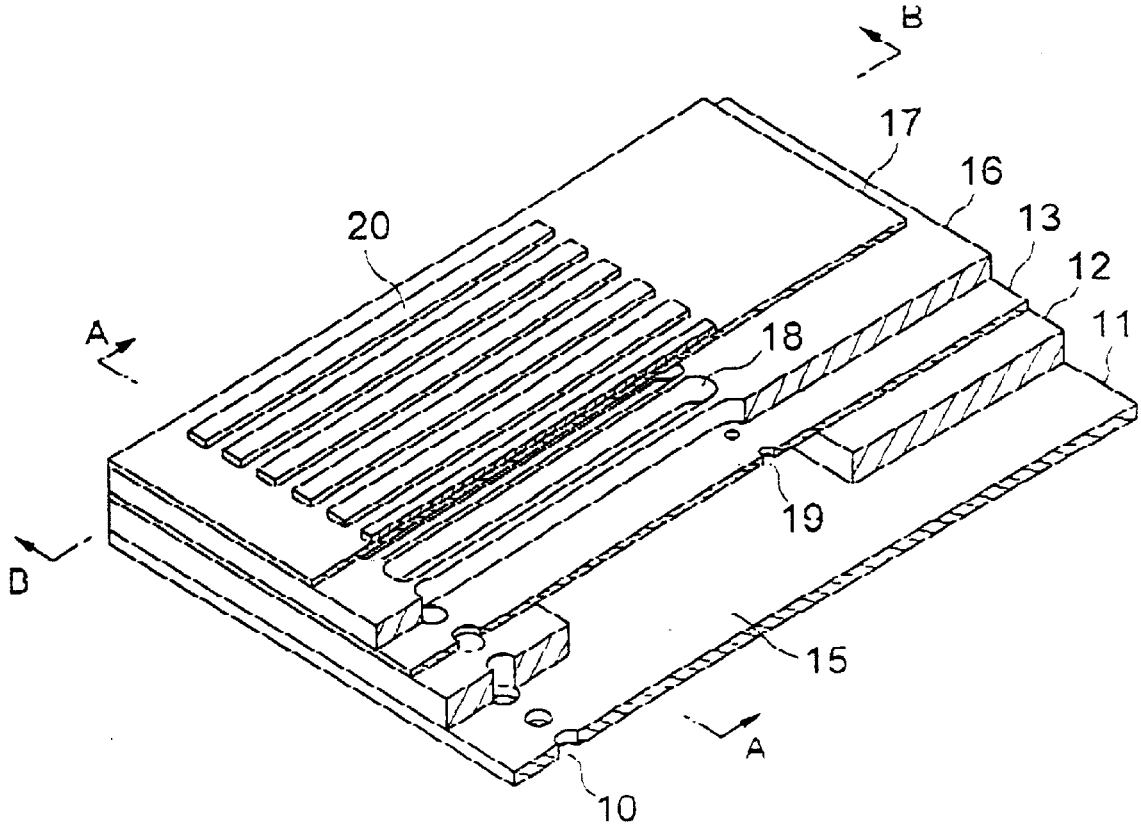
FIG. 1 PRIOR ART
FIG. 1 is a perspective view showing a conventional ink-jet recording head.
Figure 2A:
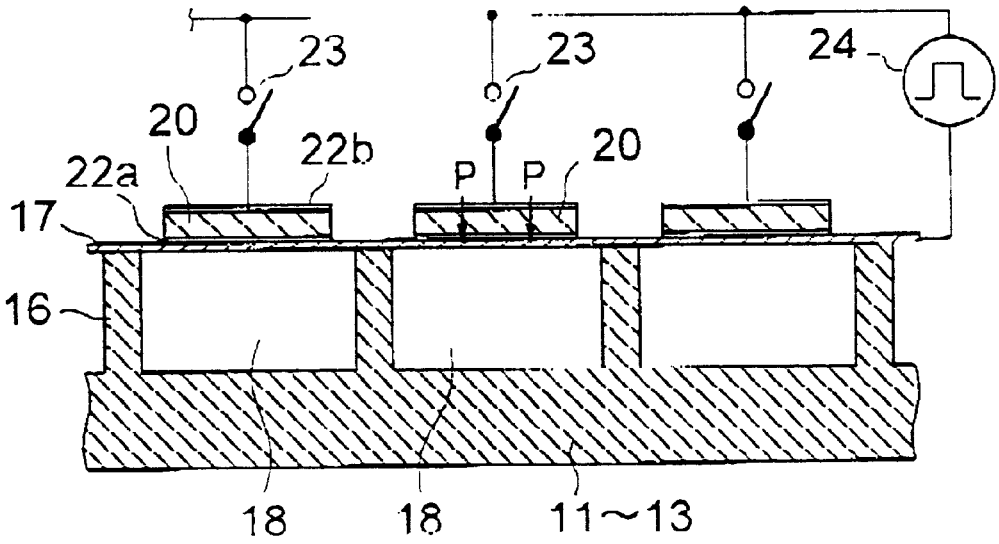
FIG. 2A PRIOR ART
FIGS. 2A and 2B are sectional views taken along the line A—A in FIG. 1 showing an operation principle of an ink-jet recording head.
Figure 2B:
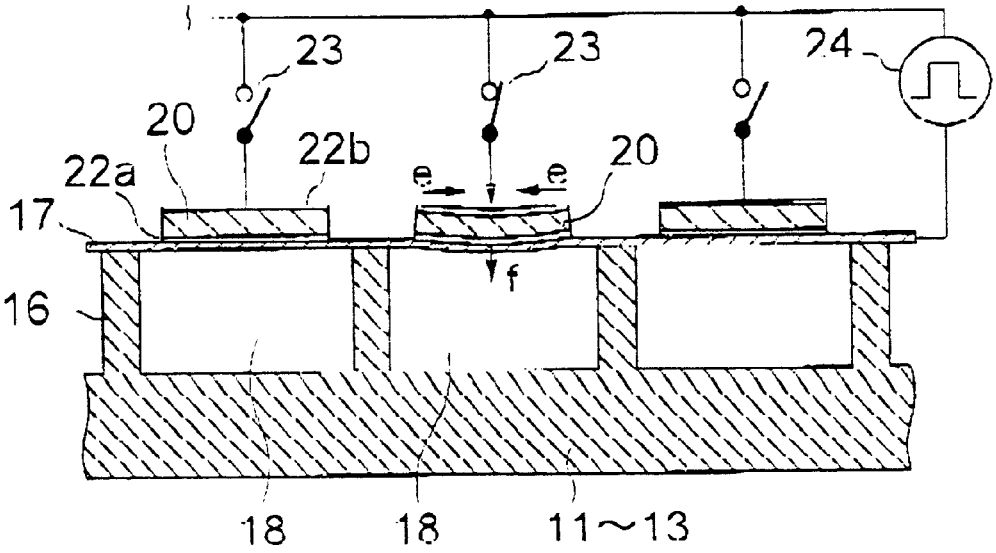
FIG. 2B PRIOR ART
Figure 3A:
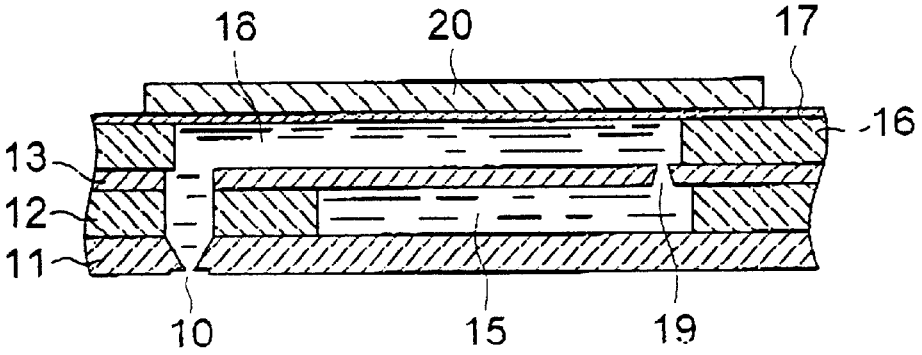
FIG. 3A PRIOR ART
FIGS. 3A, 3B and 3C are sectional views taken along the line B—B in FIG. 1 showing an ink-ejecting operation of a conventional ink-jet recording head.
Figure 3B:
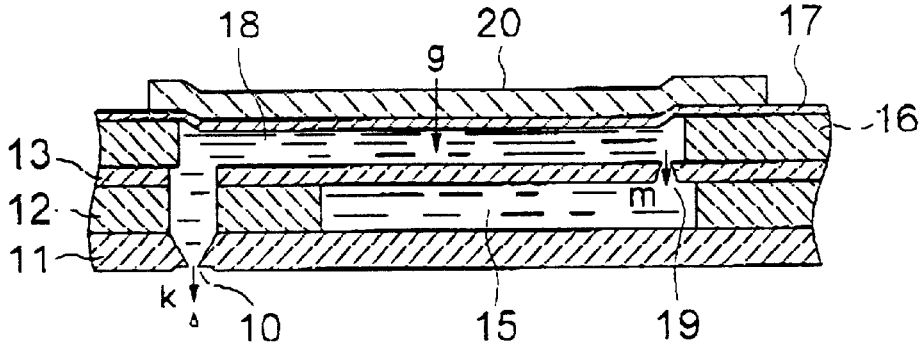
FIG. 3B PRIOR ART
Figure 3C:
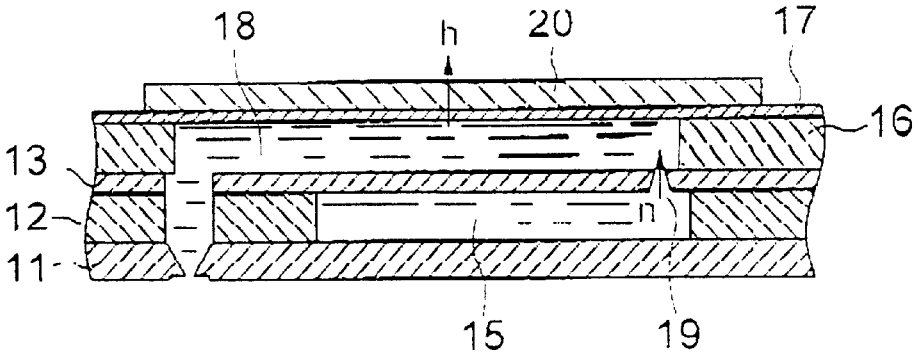
FIG. 3C PRIOR ART
Figure 4:
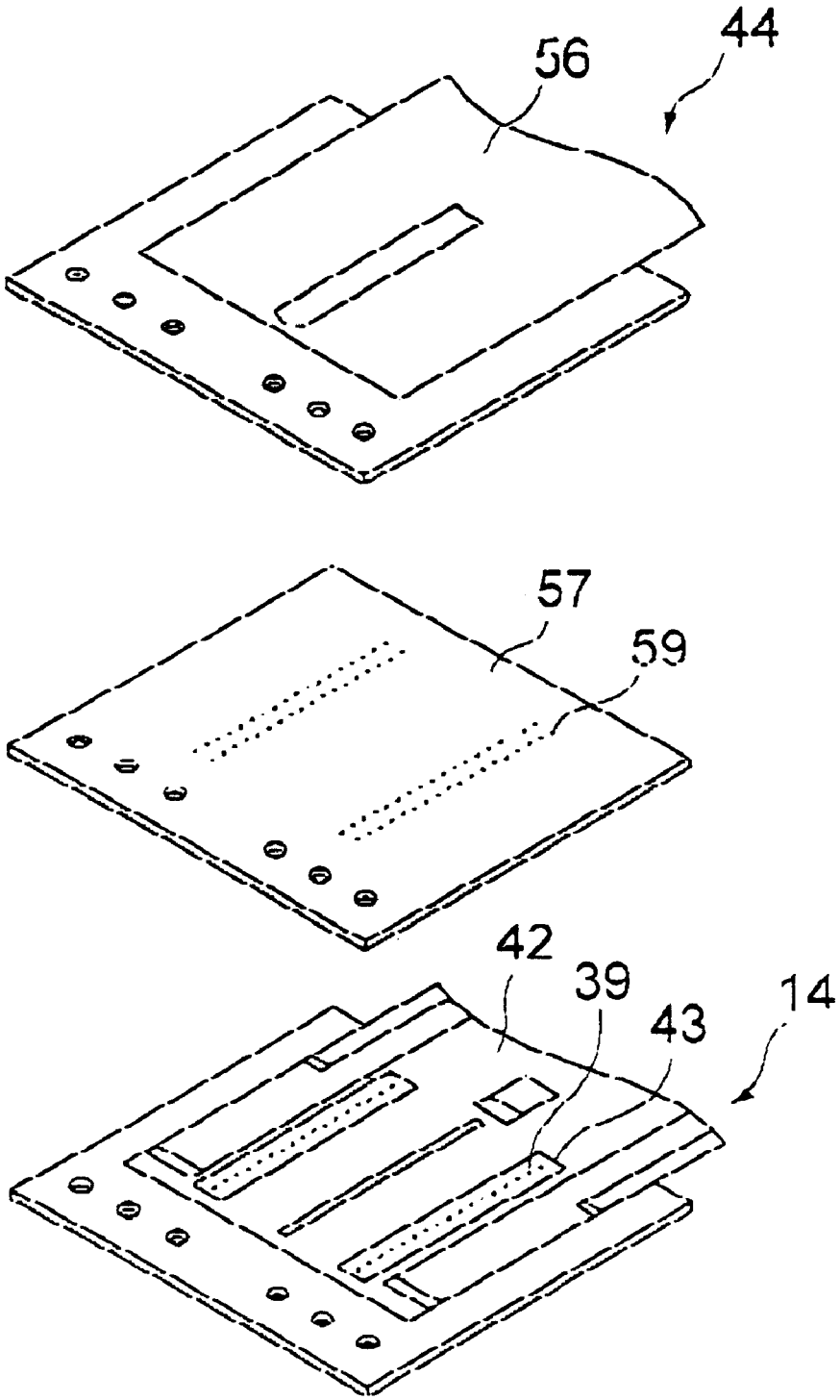
FIG. 4 is a broken perspective view showing a state before final assembling of an ink-jet recording head in accordance with an embodiment of the present invention.
Figure 5:
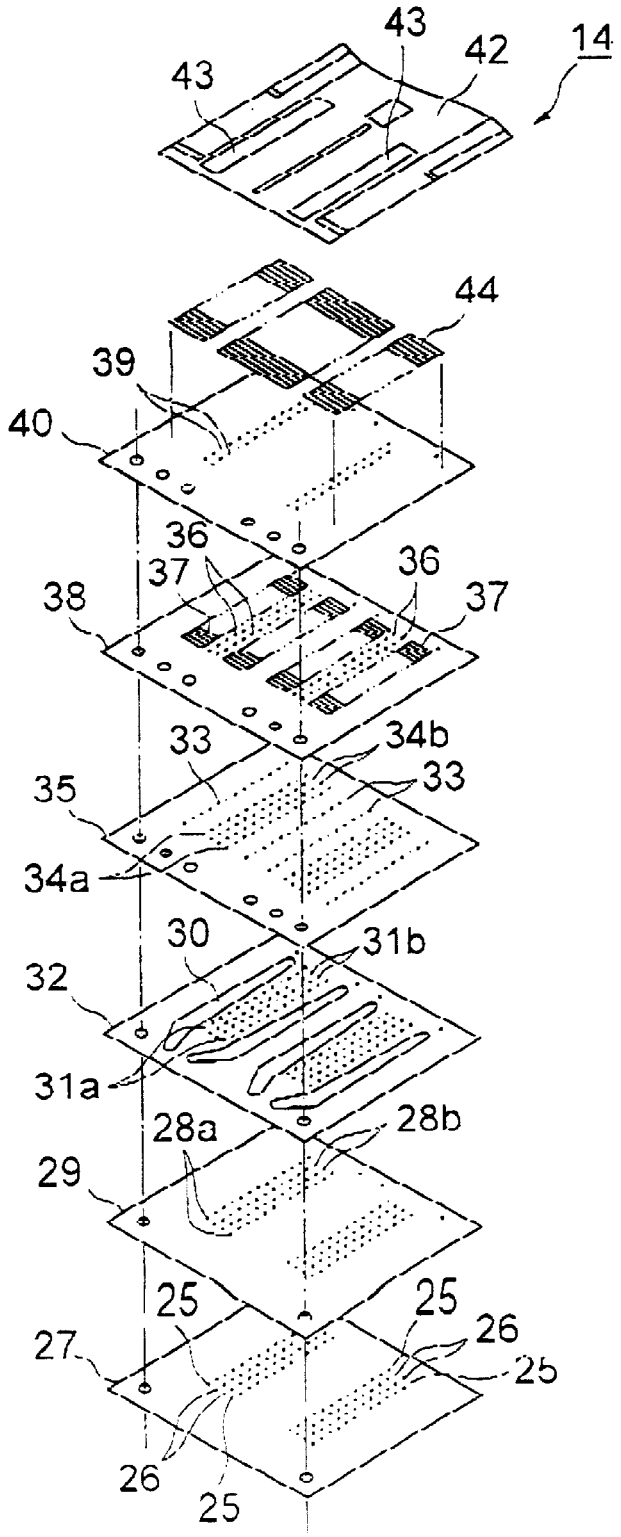
FIG. 5 is a broken perspective view showing a first head unit of the ink-jet recording head in FIG. 4.

Referring to FIG. 4, an ink-jet recording head according to an embodiment of the present invention includes a first head unit 14, a second head unit 44 and a communicating plate 57, wherein the head units 14, 44 are tightly fixed to each other with the communicating plate 57 sandwiched therebetween. The first head 14 has a communicating cable 42 on its top surface, and rows of penetration apertures 39 are exposed through an opening 43 of the communicating cable 42 as shown in FIG. 5. Penetration apertures 59 of the communicating plate 57 on the communicating cable 42 are communicated to each of the penetration apertures 39. Penetration apertures (not shown) formed on the bottom surface of the second head unit 44 are communicated to the penetration apertures 59 of the communicating plate 57.

As shown in FIG. 5, the first head unit 14 includes a nozzle plate 27 having ink nozzles 25, 26, a dumper plate 29 having penetration apertures 28*a*, 28*b* communicated to the ink nozzles 25, 26, and a pool plate 32 defining an ink pool by penetration apertures 31*a*, 31*b* communicated to the penetration apertures 28*a*, 28*b*, the dumper plate 29 and a supply plate 35, in this turn from the bottom. The first head unit 14 further includes the supply plate 35 having penetration apertures 34*a*, 34*b* communicated to the penetration apertures 31*a*, 31*b* and an ink supply port 33, a pressure chamber plate 38 having penetration apertures 35 communicated to the penetration apertures 24*b* and a pressure chamber 37 and a vibration plate 40 having penetration apertures 39 communicated to the penetration apertures 36, in this turn thereon.

Figure 7:
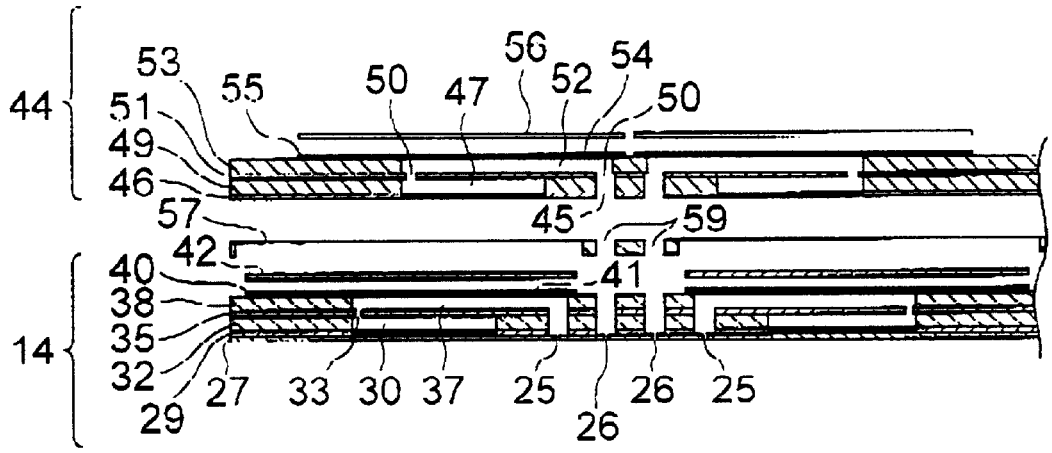
FIG. 7 is a sectional view showing the main portion of the ink-jet recording head in FIG. 4.
Figure 8:
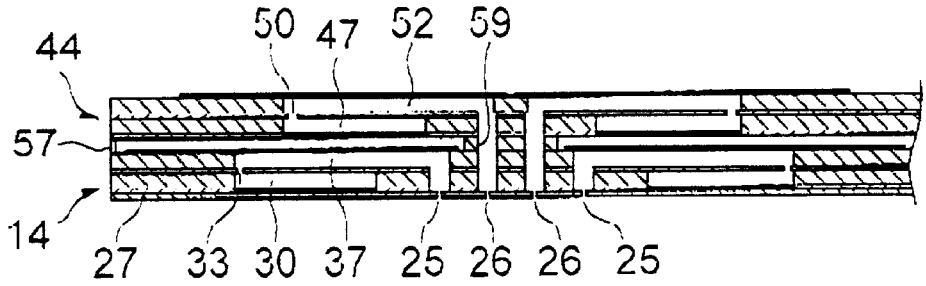
FIG. 8 is a sectional view showing the ink-jet recording head in FIG. 4 in which the respective elements are fixed to one another.

The ink nozzles 25, 26 correspond to the head units 14, 44, and 32 nozzles for each of the ink nozzles are arranged in rows. Each of the penetration apertures 28*a*, 28*b*, 31*a*, 31*b*, 34*a*, 34*b*, 36 and 39 forming the ink paths for supplying the ink to the ink nozzles 25, 26 are arranged in rows each having 32 apertures. Further, 32 pressure chambers corresponding to the ink supply ports 33 and the penetration aperture 34*b* are arranged in four rows. Preferably, as shown in FIGS. 7 and 8, each nozzle 25 is in flow communication with an end of a respective chamber 37, whereas each nozzle 26 is in communication with end regions of chambers 52 of the second head unit 44. Four rows each having 32 piezoelectric elements 41 are fixed on the specified part of the vibration plate 40, and the corresponding terminal of the communication terminal 42 is communicated to each of the piezoelectric element 41. The communication terminal 42 has a rectangular opening 43 for exposing the rows of the penetration apertures 39 of the vibration plate 40.

Figure 6:
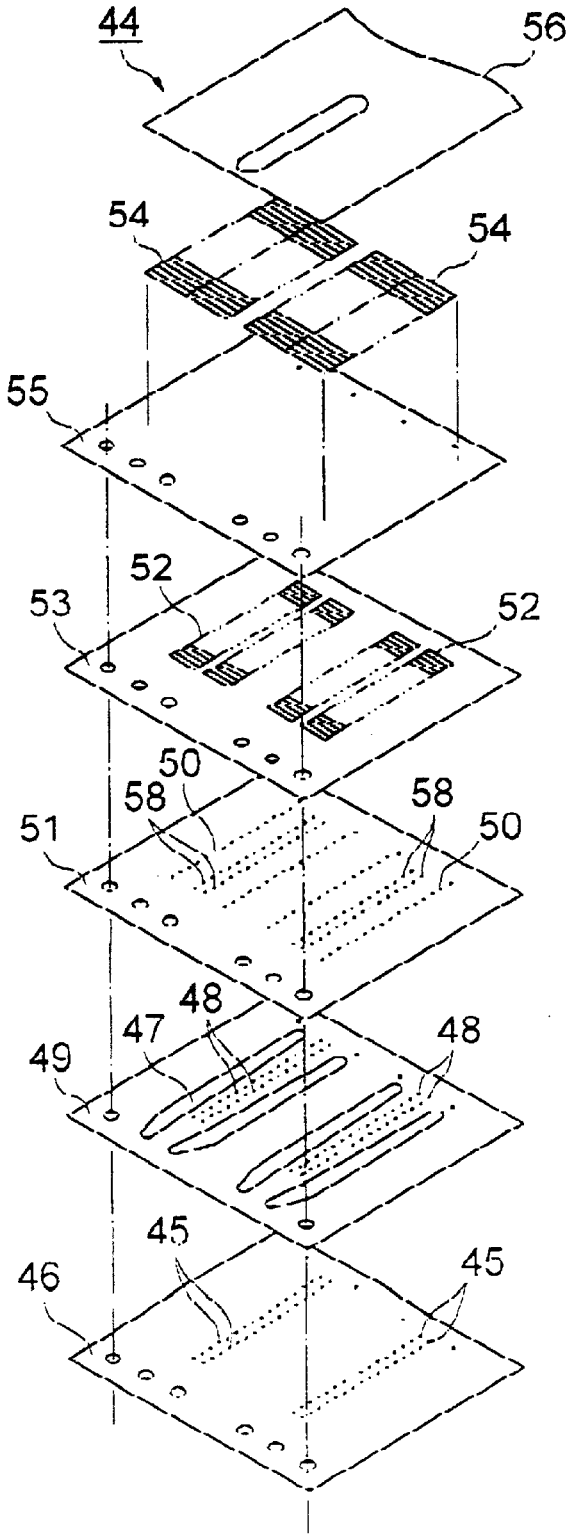
FIG. 6 is a broken perspective view showing a second head unit of the ink-jet recording head in FIG. 4.

As shown in FIG. 6, the second head unit 44 includes a dumper plate 46 having penetration apertures 45 communicated to the penetration apertures 39; a pool plate 49 having an opening 47 for defining an ink pool with the dumper plate 46 and a supply plate 51, and penetration apertures 48 communicated to the penetration apertures 45; the supply plate 51 having penetration apertures 50 communicated to the penetration apertures 47 and penetration apertures 58 communicated to the penetration apertures 48; a pressure chamber plate 53 having pressure chambers 52; and a vibration plate 55 having piezoelectric elements 54 corresponding to each of the pressure chambers 52, in this turn from the bottom.

Each of the penetration apertures 45, 48 and 58 and the ink supply ports 50 forming the ink paths for supplying the ink to the ink nozzles 26 are arranged in rows having 32 pieces. The pressure chambers 52 arranged in four rows each having 32 chambers at the position corresponding to the ink supply ports 50 and the penetration apertures 58. A plurality of the piezoelectric elements 54 having an arrangement similar to the first head unit 14 are fixed to the vibration plate 55, and the corresponding terminal of a communicating cable 56 is communicated to each of the piezoelectric elements 54. The respective elements of the head units 14, 44 have fixation apertures, and a bolt is inserted through the overlapped fixation apertures for fixing the elements to one another.

As shown in FIG. 7 showing the left half of the ink-jet recording head of FIG. 4, the ink-jet recording head includes the first head unit 14, the communicating plate 57 and the second head unit 44 in this turn from the bottom.

The operation of the ink-jet recording head will be described referring to FIG. 8 in addition to FIGS. 4 to 7.

The ink is separately supplied to the ink pools 30, 47 before the printing. In the first recording head 14, the ink is filled in the ink nozzles 25 through the ink pool 30, the ink supply port 33, the pressure chamber 37 and the penetration apertures 36, 34*a*, 31*a* and 28*a* (FIG. 5). When the printing order is input under the situation, the vibration plate 40 vibrates by the electricity supply to the piezoelectric element 41 to eject the ink through the ink nozzles 25 because the inside of the corresponding pressure chamber 37 is pressurized.

In the second recording head 44, the ink is filled in the ink nozzles 26 through the ink pool 47, the ink supply port 50, the pressure chamber 52 and the penetration apertures 58, 48, 45 (FIG. 6), 59, 39, 36, 34*b*, 31*b* and 28*b* (FIG. 5). When the printing order is input under the situation, the vibration plate 55 vibrates by the electricity supply to the piezoelectric element 54 to eject the ink through the ink nozzles 26 because the inside of the corresponding pressure chamber 52 is pressurized. The repetition of the electricity supply/non-electricity supply to the piezoelectric element 41, 54 performs the recording operation by the ink ejection through the ink nozzles 25, 26 at specified timing.

Since the plurality of the pressure chambers 37, 52 and the corresponding piezoelectric elements 41, 54 are arranged in the vertical direction by layering the first and the second head units 14, 44 in the embodiment, the pressure chambers at each level are overlapped viewed from the ink ejection side. Accordingly, when the number of the ink nozzles is increased for responding the high density, the area occupied by all the pressure chambers is not increased, and the miniaturization of the recording head can be realized as well as the high density.

Further, the space for arranging the ink nozzles 25, 26 becomes compact because the ink nozzles 25, 26 are localized on the opposing surface 27 to the printing medium, and the first ink nozzle rows 25 communicated to the pressure chambers 27 of the first head unit 14 and the second ink nozzle rows 26 communicated to the pressure chambers 52 of the second head unit 44 are aligned. The arrangement space becomes more compact because the first and the second ink nozzle rows 25, 26 opposite to each other on the opposing surface 27.

The first and the second head units 14, 44 are fixed to each other after each is individually assembled because they are sequentially layered from the opposing surface side. The ink path from the second head unit 44 to the opposing surface can be made minimum to make the recording head structure more compact because the ink path communicating the pressure chamber 52 of the second head unit 44 to the ink nozzle 26 penetrates the first head unit 14.

Figure 9:
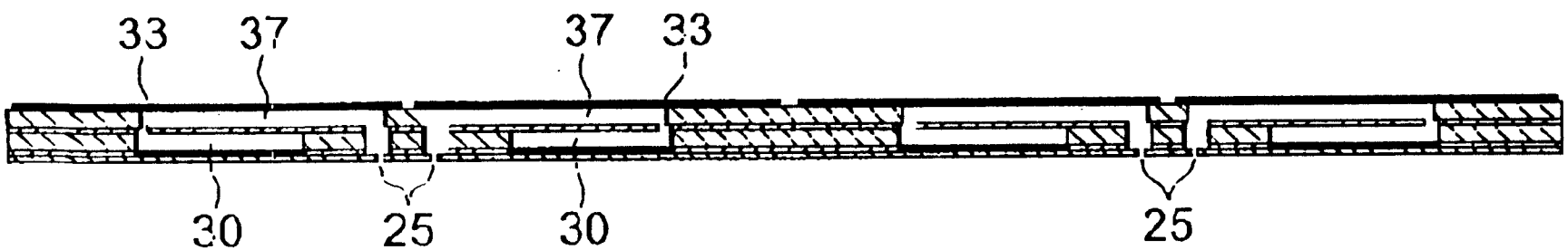
FIG. 9 PRIOR ART
FIG. 9 is a sectional view showing a conventional ink-jet recording head in Comparative Example.

An example of the conventional ink-jet recording head structure is shown in FIG. 9 in which the corresponding elements to those of the above embodiment are designated by the same numerals. It is understood that the area occupied by the ink nozzles on the ink-ejected surface can be considerably reduced in the embodiment for forming the same number of the ink nozzles when the both structures are compared with each other.

Although the two head units are layered in the embodiment, three or more head units may be layered in the present invention. Further, the pressure chambers are not necessarily overlapped completely, and the partial overlapping may be possible.

Since the above embodiments are described only for examples, the present invention is not limited to the above embodiments and various modifications or alternations can be easily made therefrom by those skilled in the art without departing from the scope of the present invention.

What is claimed is:

1. An ink jet head comprising:

at least two rows of first ink nozzles and at least two rows of second ink nozzles between the two rows of first ink nozzles in a nozzle plane;

a respective row of first pressure chambers in a first chamber plane above said nozzle plane and assigned to each of said two rows of first ink nozzles, said first pressure chambers being elongated transversely to a respective row of first ink nozzles and communicating with a respective first ink nozzle at an end of a respective first pressure chamber;

a respective row of second pressure chambers in a second chamber plane above said first chamber plane and assigned to each of said two rows of said second ink nozzles, said second pressure chambers being elongated transversely to a respective row of second ink nozzles and communicating with a respective second ink nozzle at an end of a respective second pressure chamber through said first chamber plane, each row of the second pressure chambers overlapping a respective row of the first pressure chambers; and a plurality of rows of first and second pressure-generating elements extending over said rows of said first and second pressure chambers, respectively, for selectively ejecting ink droplets from each of said first and second ink nozzles on a printing medium.

2. An ink-jet recording head according to claim 1, wherein said nozzle plane is juxtaposed with the printing medium.

3. An ink-jet recording head according to claim 1, wherein said ends of adjacent first pressure chambers are spaced from one another in a direction transverse to said two rows of the first ink nozzles at a distance greater than a distance between said ends of adjacent second pressure chambers spaced from one another in the same direction.

4. An ink-jet recording head according to claim 1 further comprising a plurality of pools extending parallel to said rows of the first and second ink nozzles and being in flow communication with a respective one of said first and second pressure chambers, at least one pool of said plurality of pools in combination with said row of said first pressure chambers and the respective row of pressure generating elements forming a first head unit, and at least one another pool of said plurality of pools in combination with said row of said second pressure chambers and the respective row of pressure-generating elements forming a second head unit above said first head unit.

5. An ink-jet recording head according to claim 4, wherein said two rows of the first ink nozzles and two rows of the second ink nozzles are provided in said first head unit facing the printing medium.

6. An ink-jet recording head according to claim 1 further comprising a plurality of parallel flow paths extending from the ends of said ends of the first and second pressure chambers toward respective first and second ink nozzles.

7. An ink-jet recording head according to claim 1, wherein said first and second pressure generating elements are piezoelectric elements.

* * * * *